US007775815B2

(12) United States Patent
Takahashi et al.

(10) Patent No.: US 7,775,815 B2
(45) Date of Patent: Aug. 17, 2010

(54) LIF CONNECTOR

(75) Inventors: Toshiharu Takahashi, Makinohara (JP); Kazuto Ohtaka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/407,848

(22) Filed: Mar. 20, 2009

(65) Prior Publication Data

US 2009/0253282 A1 Oct. 8, 2009

(30) Foreign Application Priority Data

Apr. 3, 2008 (JP) ..... 2008-096794

(51) Int. Cl.
*H01R 13/62* (2006.01)

(52) U.S. Cl. ..... 439/157

(58) Field of Classification Search ..... 439/157, 439/160, 141, 158–159
See application file for complete search history.

(56) References Cited

U.S. PATENT DOCUMENTS 6,666,704 B2 * 12/2003 Rodney, Sr. ..... 439/352
6,739,901 B2 * 5/2004 Maeda ..... 439/488
6,824,406 B1 * 11/2004 Sharples et al. ..... 439/157
7,445,474 B2 * 11/2008 Sakatani et al. ..... 439/157
7,458,832 B2 * 12/2008 Shibata ..... 439/157
2007/0020978 A1 * 1/2007 Murakami et al. ..... 439/157

FOREIGN PATENT DOCUMENTS

JP 2004-103557 A 4/2004
JP 2006-185772 A 7/2006

* cited by examiner

*Primary Examiner*—Jean F Duverne
(74) *Attorney, Agent, or Firm*—Sughrue Mion, PLLC

(57) ABSTRACT

The invention provides a LIF connector in which the number of component parts is reduced, and the efficiency of an assembling operation is enhanced, and further an automatic mounting operation can be effected, and a good operability is obtained. The LIF connector of the present invention includes a frame forming an opening and including a guide hole, a fulcrum boss guide groove extending from the opening, a fulcrum boss passage portion formed between the guide hole and the fulcrum boss guide groove, and a first groove; a first connector accommodated by the frame through the opening and including a fulcrum boss to be engaged with the guide hole by passing through the fulcrum boss guide groove and the fulcrum boss passage portion and a second groove; and a second connector including an application boss engaged with the first and the second groove. The second connector is engaged with the first connector by pivotally moving the frame.

6 Claims, 10 Drawing Sheets

LIF CONNECTOR

BACKGROUND

This invention relates to a low insertion force connector (LIF connector) in which male and female multi-pole connectors each having a number of metal terminals can be fitted together with a low insertion force.

JP2004-103557 and JP2006-185772 disclose related LIF connectors. The LIF connector 1 disclosed in JP2004-103557 and shown in FIG. 9 is of the type adapted to be fixed on a panel of a vehicle body (not shown), and this LIF connector 1 includes a connector holder 2 adapted to be mounted on the vehicle body panel, a first connector 3 for being fixed to the connector holder 2, and a second connector 4 for being fitted to the first connector 3 fixed to the connector holder 2, and a lever 5 which is pivotally mounted on the second connector 4 and can be pivotally moved to fit the second connector 4 to the first connector 3.

The LIF connector 11 disclosed in JP2006-185772 and shown in FIG. 10 is of the type which does not need to be mounted on a vehicle body panel (that is, does not need to be provided with a connector holder). This LIF connector 11 includes a first connector 12, and a lever 13 which is pivotally mounted on the first connector 12 and can be pivotally moved to draw a second connector (not shown) to fit this second connector to the first connector 12, The LIF connector 11 is so formed that the lever 13 can be automatically mounted on the first connector 12, The structure which enables the automatic mounting will be described below.

Opening prevention portions 16 for receiving portions of arm portions 15 of the lever 13 are formed at a tubular fitting portion 14 of the first connector 12, A slide hole 18 for fitting on a pivot shaft 17 of the first connector 12 is formed in each arm portion 15, The lever 13 can be moved relative to the first connector 12 such that the pivot shaft 17 is introduced into an introduction hole 19, formed at one end of the slide hole 18, at the time of mounting the lever 13 on the first connector 12, so that the lever 13 is located in a provisionally-mounted position (see FIG. 10B). Thereafter, the lever 13 is pushed in a direction of extension of the slide hole 18, and the pivot shaft 17 reaches a pivot hole 20 formed at the other end of the slide hole 18, so that the lever 13 is located in a completely-mounted position (see FIG. 10C).

The lever 13 is so constructed that the two arm portions 15 can be deformed to be opened (or moved away from each other) at the time when the slide holes 18 fit on the respective pivot shafts 17 and that the arm portions 15 will not be deformed to be opened at the time when the arm portions 15 enter arm receiving spaces of the opening prevention portions 16, With this construction, the automatic mounting of the lever 13 can be achieved before the lever 13 is brought into the provisionally-mounted position although the LIF connector 11 has the opening prevention portions 16.

The LIF connector 1 disclosed in JP2004-103557 is formed by the four members, that is, the connector holder 2, the first connector 3, the second connector 4 and the lever 5, Therefore, this LIF connector has a problem that the number of the component parts is relatively large. Because of the increased number of the component parts, there is encountered another problem that much time and labor are required for assembling the LIF connector and for mounting this LIF connector on the vehicle body panel (not shown).

On the other hand, in the LIF connector 11 disclosed in JP2006-185772, although the automatic mounting of the lever 13 can be effected, each pivot shaft 17 slides in and along the slide hole 18, and therefore the following problem is encountered. Namely, because of the existence of slide portions of the slide hole 18, that portion of the pivot hole portion 20 for supporting the pivot shaft 17 can not be sufficiently secured, and therefore there is a fear that the operation (that is, the pivotal movement) of the lever 13 may be adversely affected.

In the case where the automatic mounting of the lever 13 is not achieved, the lever 13 need to be deformed to be opened by a manual operation. In this case, there is encountered a problem that the efficiency of the assembling operation is lowered.

This invention has been made in view of the above circumstances, and an object of the invention is to provide a vehicle body panel fixing-purpose LIF connector, in which the number of component parts is reduced, and the efficiency of an assembling operation is enhanced, and further an automatic mounting operation can be effected, and a good operability is obtained.

SUMMARY

The above object has been achieved by a LIF connector as the first aspect of the invention including a frame forming an opening and including a guide hole, a fulcrum boss guide groove extending from the opening to the guide hole, a fulcrum boss passage portion formed between the guide hole and the fulcrum boss guide groove, and a first groove; a first connector accommodated by the frame through the opening and including a fulcrum boss to be engaged with the guide hole by passing through the fulcrum boss guide groove and the fulcrum boss passage portion and a second groove; and a second connector including an application boss engaged with the first and the second groove, wherein the second connector is drawn to the first connector by pivotally moving the frame. Preferably, the fulcrum boss guide groove linearly extends from the opening.

In the invention having these features, the LIF connector is formed by the three parts. The frame having part of the LIF mechanism serves to reduce the number of the component parts.

In the invention, when inserting the first connector into the frame, the fulcrum boss is guided by the extending fulcrum boss guide groove (preferably linearly extending), and then slides over the fulcrum boss passage portion continuous from this fulcrum boss guide groove, and is fitted into the guide hole. The LIF connector of the invention has such a structure that the first connector is mounted straight into the frame, and therefore the automatic assembling of the two parts can be effected. And besides, thanks to this structure, the support portion of the guide hole for supporting the fulcrum boss can be sufficiently secured (see the following Section "EMBODIMENT").

In the LIF connector as the second aspect of the invention according to the first aspect, at least one of the fulcrum boss and the fulcrum boss passage portion includes a tapered portion for overriding during engagement between the first connector and the frame.

In the invention having this feature, thanks to the provision of the tapered portion, the fulcrum boss guided by the fulcrum boss guide groove can smoothly slide (or pass) over the fulcrum boss passage portion. Because of this smooth passage, the opening deformation of the frame occurs only instantaneously, and adverse effects on the shape, etc., can be kept to a minimum. The fulcrum boss, after passing over the fulcrum boss passage portion, is fitted into the fulcrum boss guide hole.

In the LIF connector as the third aspect of the invention according to the first or second aspect, the first connector further includes a projection and the frame includes an abutment portion on which the projection abuts and a projection introduction potion into which the projection is received so as to prevent inverse engagement between the first connector and the frame.

In the invention having these features, unless the first connector is inserted into the frame in the proper direction, the projection is brought into abutting engagement with the abutment portion, so that the first connector can not be received in the frame, thus detecting the reverse mounting.

In the LIF connector as the fourth aspect of the invention according to the first, second or third aspect, the fulcrum boss has a first lever opening prevention projection projecting perpendicular to the axis of the fulcrum boss; and a first projection relief portion and a first projection engagement portion for the first lever opening prevention projection are formed on a periphery of the guide hole.

In the invention having these features, the fulcrum boss is fitted into the guide hole, and then when the frame is pivotally moved relative to the first connector, the opening deformation of the frame is prevented by the engagement of the first lever opening prevention projection with the first projection engagement portion.

In the LIF connector as the fifth aspect of the invention according to the first, second or third aspect, the application boss has a second lever opening prevention projection projecting perpendicular to the axis of the application boss; and a second projection relief portion and a second projection engagement portion for the second lever opening prevention projection are formed on a periphery of the first groove.

At least one of the first lever opening prevention projection and the second lever opening prevention projection is engaged with the first projection engagement portion and the second projection engagement portion respectively at least during pivotal movement of the frame.

In the invention having these features, the fulcrum boss is fitted into the guide hole, and then when the frame is pivotally moved relative to the first connector, thereby starting the fitting of the second connector to the first connector, the opening deformation of the frame is prevented by the engagement of the first lever opening prevention projection with the first projection engagement portion and/or the engagement of the second lever opening prevention projection with the second projection engagement portion. Thanks to the provision of the above structure, each opening prevention projection can be reduced in size, and besides the range of engagement of the first lever opening prevention projection with the first projection engagement first can be reduced (see the following Section "EMBODIMENT")

According to the first aspect of the invention, there is achieved an advantage that the LIF connector, having the mechanism for enabling the first and second connectors to be fitted together with a low insertion force, can be formed by a smaller number of component parts as compared with the related LIF connectors. Because of the smaller number of component parts, there is achieved another advantage that the efficiency of the operation can be enhanced.

According to the second aspect of the invention, there are provided the fulcrum boss guide groove and the fulcrum boss passage portion for the fulcrum boss, and the first connector can be mounted straight into the frame. Therefore, there is achieved an advantage that the structure can meet the automatic mounting operation. Furthermore, slide holes as in the related connectors are not formed, and therefore the support portion for supporting the fulcrum boss can be sufficiently secured, and a good operability can be achieved.

According to the second aspect of the invention, the fulcrum boss can smoothly slide over the fulcrum boss passage portion. Therefore, there is achieved an advantage that the operation for automatically mounting the first connector in the frame can be effected more efficiently.

According to the third aspect of the invention, there is achieved an advantage that the reverse mounting of the first connector is prevented.

According to the fourth aspect of the invention, there is achieved an advantage that the opening deformation of the frame is prevented. Therefore, there is achieved an advantage that the connector is prevented from being disengaged from the frame.

According to the fifth aspect of the invention, there is achieved an advantage that the opening deformation of the frame is prevented. Therefore, there is achieved an advantage that the connector is prevented from being disengaged from the frame. Furthermore, there is achieved an advantage that the opening deformation of the frame is prevented without increasing the size of the LIF connector.

BRIEF DESCRIPTION OF THE DRAWINGS

FIG. 1A is the perspective view showing a condition before a connector fitting operation is effected, and FIG. 1B the cross-sectional, perspective view showing a condition in which a first connector is in the process of being received in a lever-cum-retaining member.

FIG. 5A shows a condition in which the first connector is received, and FIG. 5B shows a condition in which the first connector is provisionally-retained.

FIG. 8A shows a condition in which the fitting operation of the second connector is started, and FIG. 8B shows the condition in which the fitting operation of the second connector is completed.

FIG. 10A shows a condition before a lever is mounted, and FIG. 10B shows a condition in which the lever is disposed in a provisionally-mounted position, and FIG. 10C shows a condition in which the lever is disposed in a completely-mounted position.

EMBODIMENT

Figure 1A:
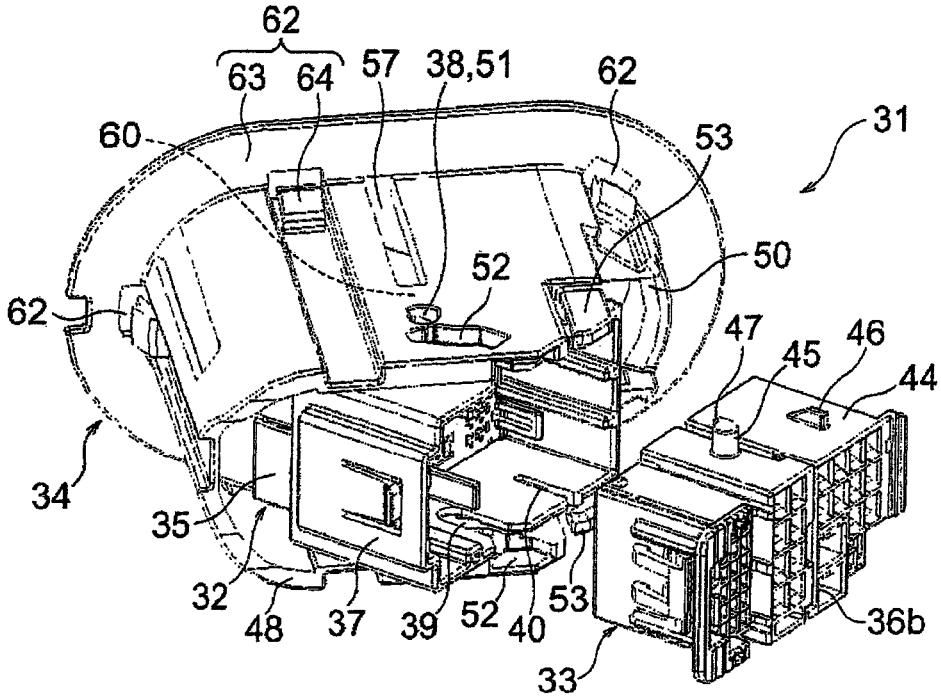
FIGS. 1A and 1B are views showing one preferred embodiment of a LIF connector of the invention.
Figure 1B:
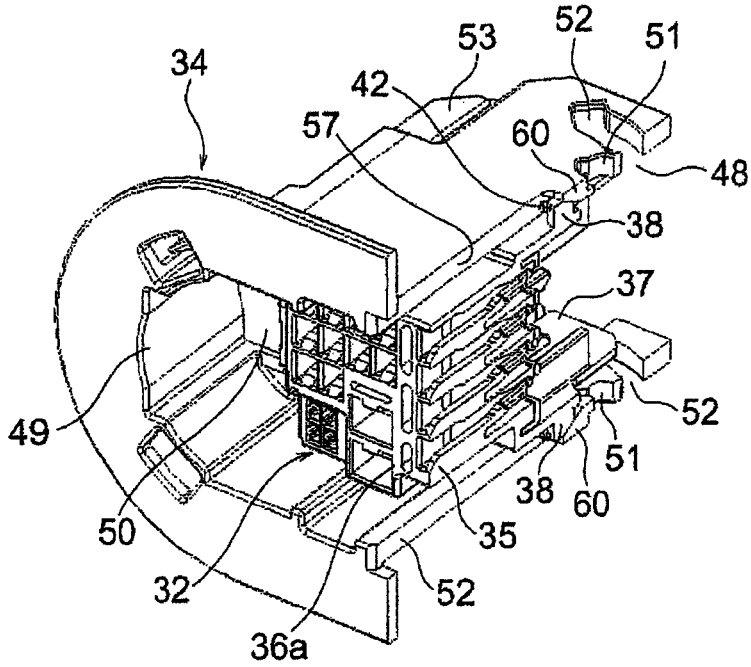
Figure 2:
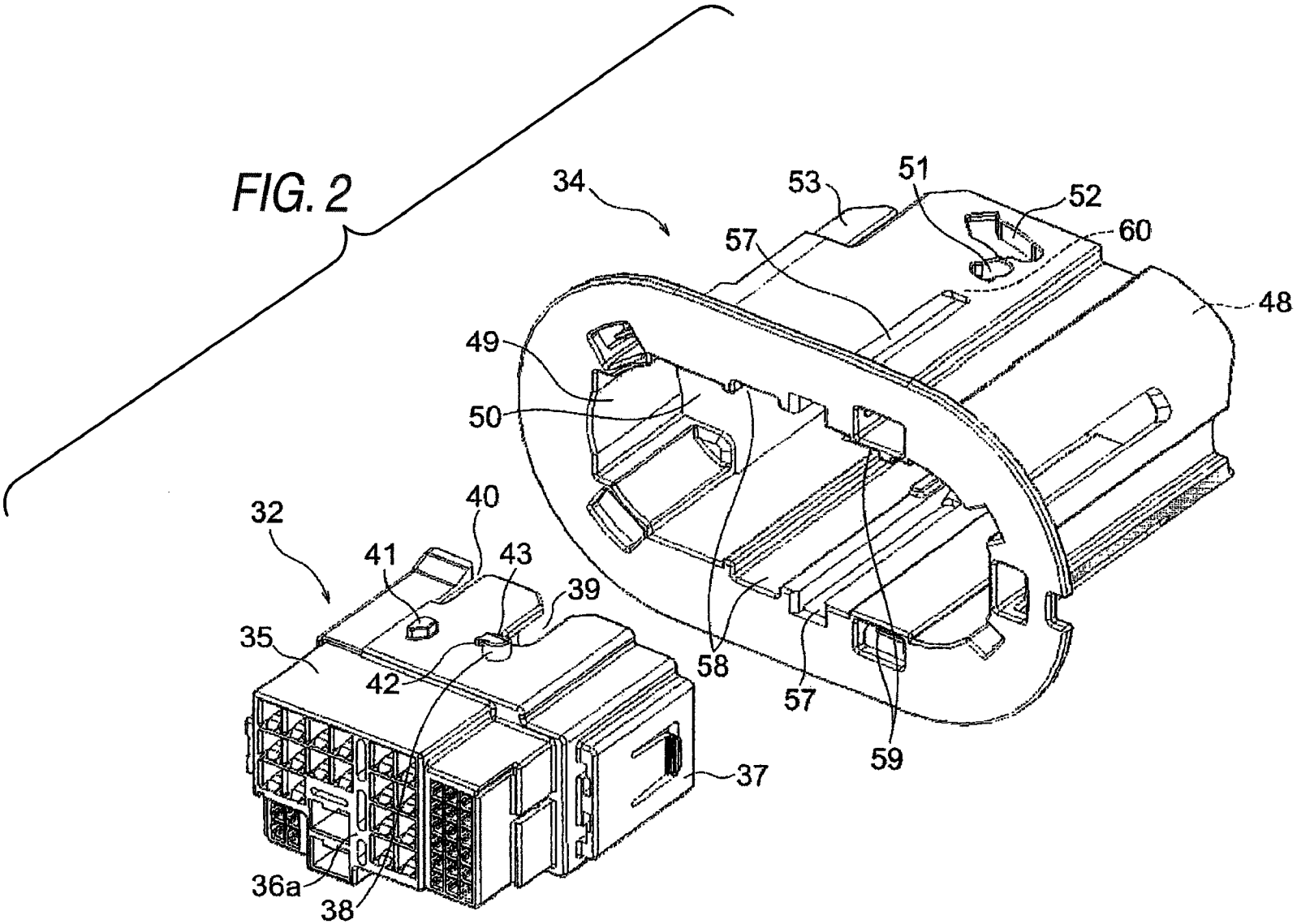
FIG. 2 is a perspective view showing a condition immediately before the first connector is received in the lever-cum-retaining member.
Figure 3:
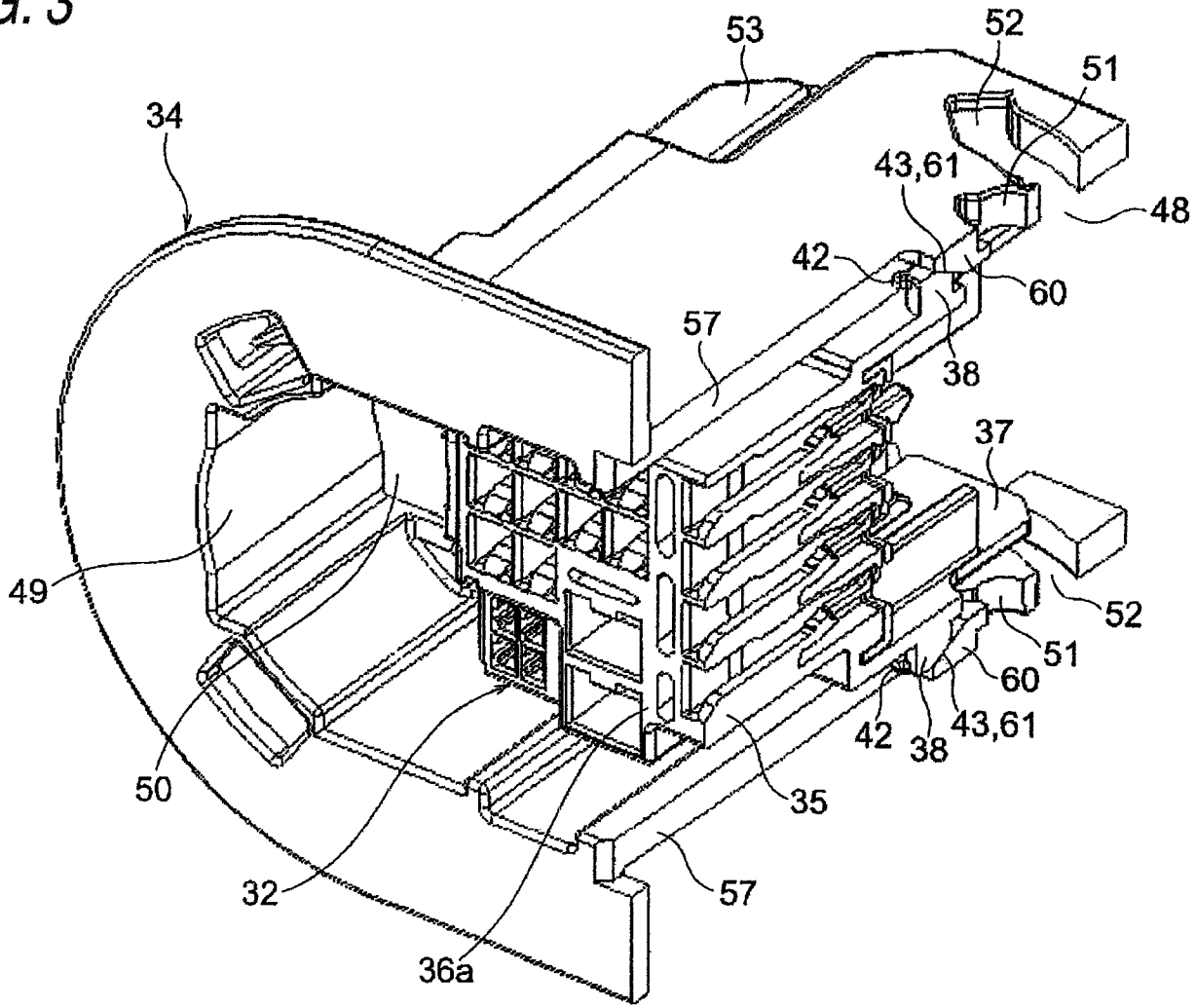
FIG. 3 is a cross-sectional, perspective view showing a condition in which the first connector is in the process of being received in the lever-cum-retaining member.
Figure 4:
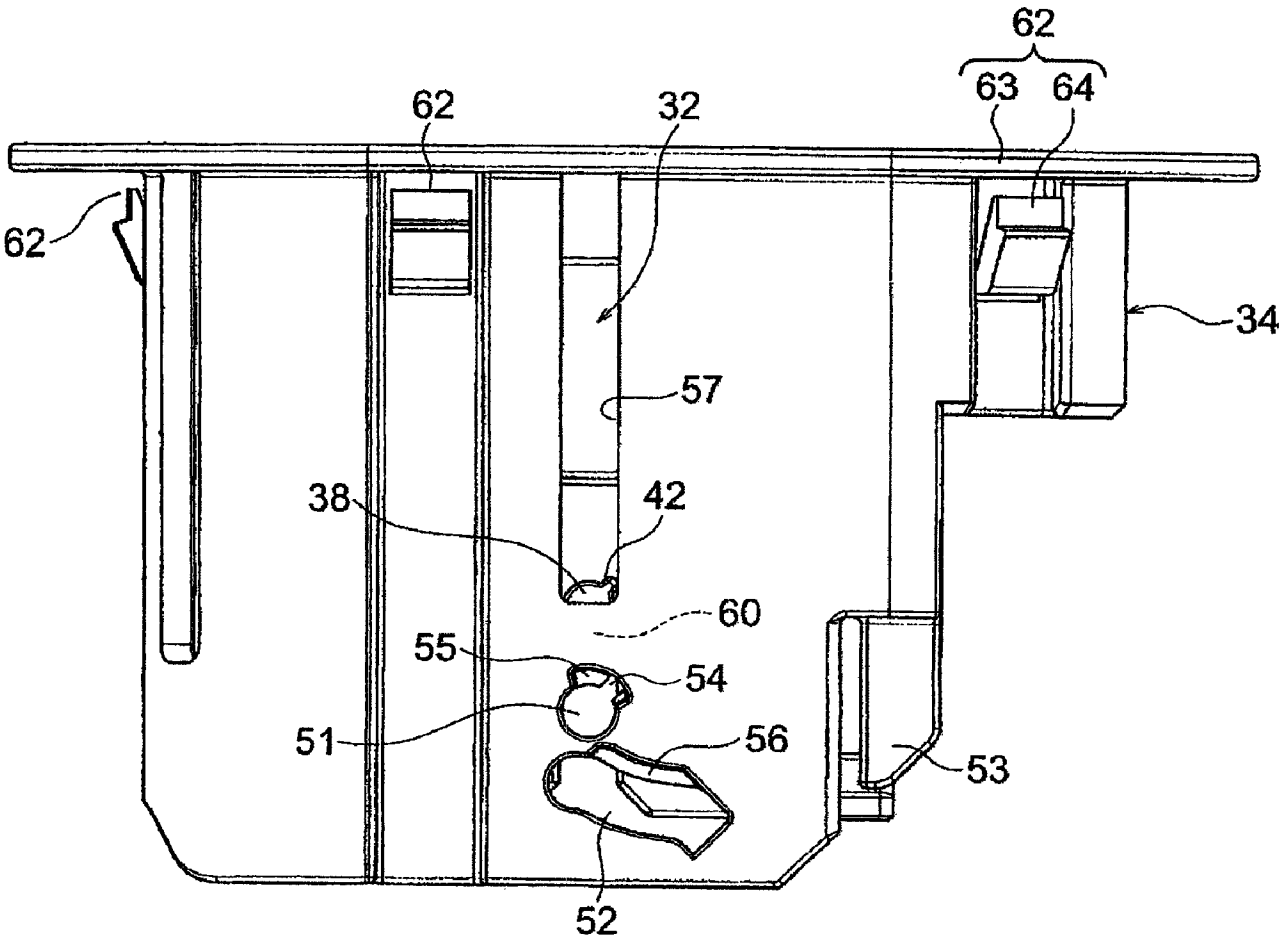
FIG. 4 is a view showing the condition in which the first connector is in the process of being received in the lever-cum-retaining member.

The present invention will now be described with reference to the drawings. FIGS. 1A and 1B show one preferred embodiment of a LIF connector of the invention, and FIG. 1A is a perspective view showing a condition before a connector fitting operation is effected, and FIG. 1B is a cross-sectional, perspective view showing a condition in which a first connector is in the process of being received in a lever-cum-retaining member (an example of the frame). FIG. 2 is a perspective view showing a condition immediately before the first connector is received in the lever-cum-retaining member. FIG. 3 is a cross-sectional, perspective view showing a condition in which the first connector is in the process of being received in the lever-cum-retaining member, and FIG. 4 is a view showing the condition in which the first connector is in the process of being received in the lever-cum-retaining member.

Figure 5B:
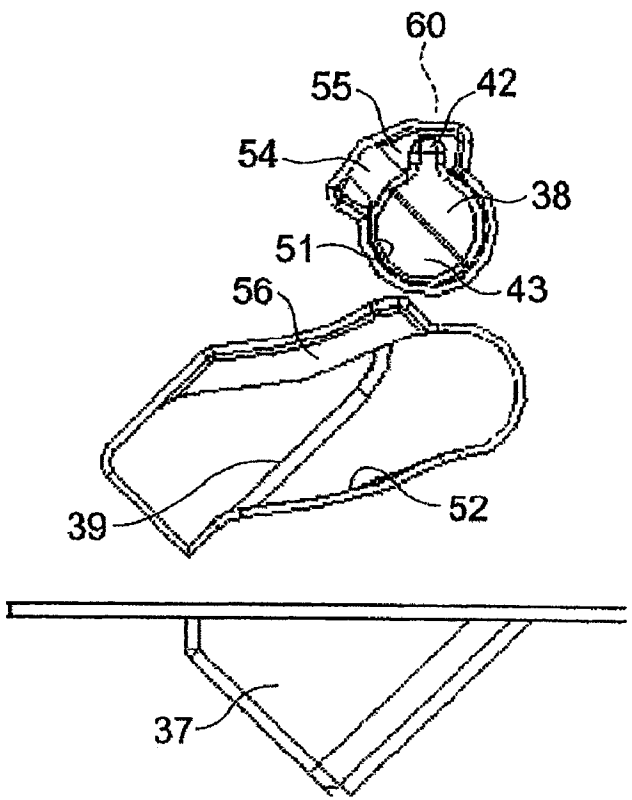
FIGS. 5A and 5B are views showing the positional relation between a first lever opening prevention projection and a first projection engagement recess portion.
Figure 5A:
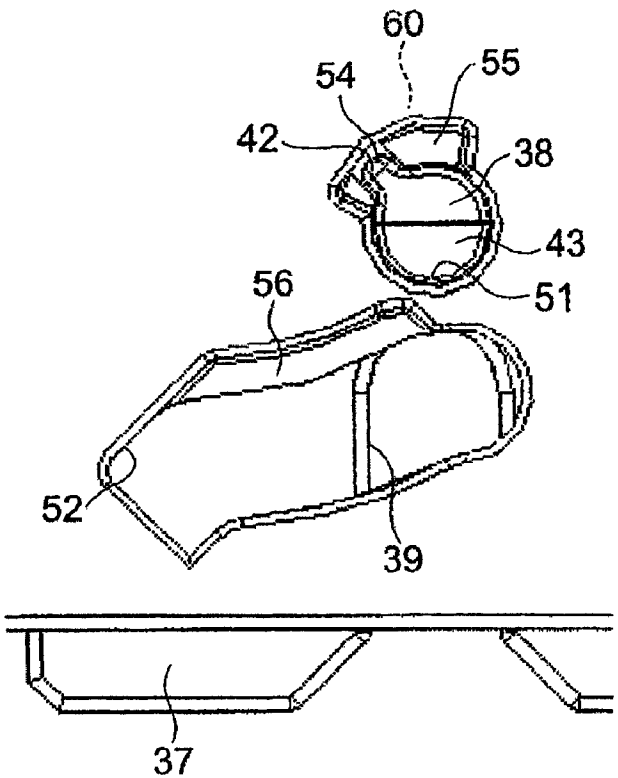
Figure 6:
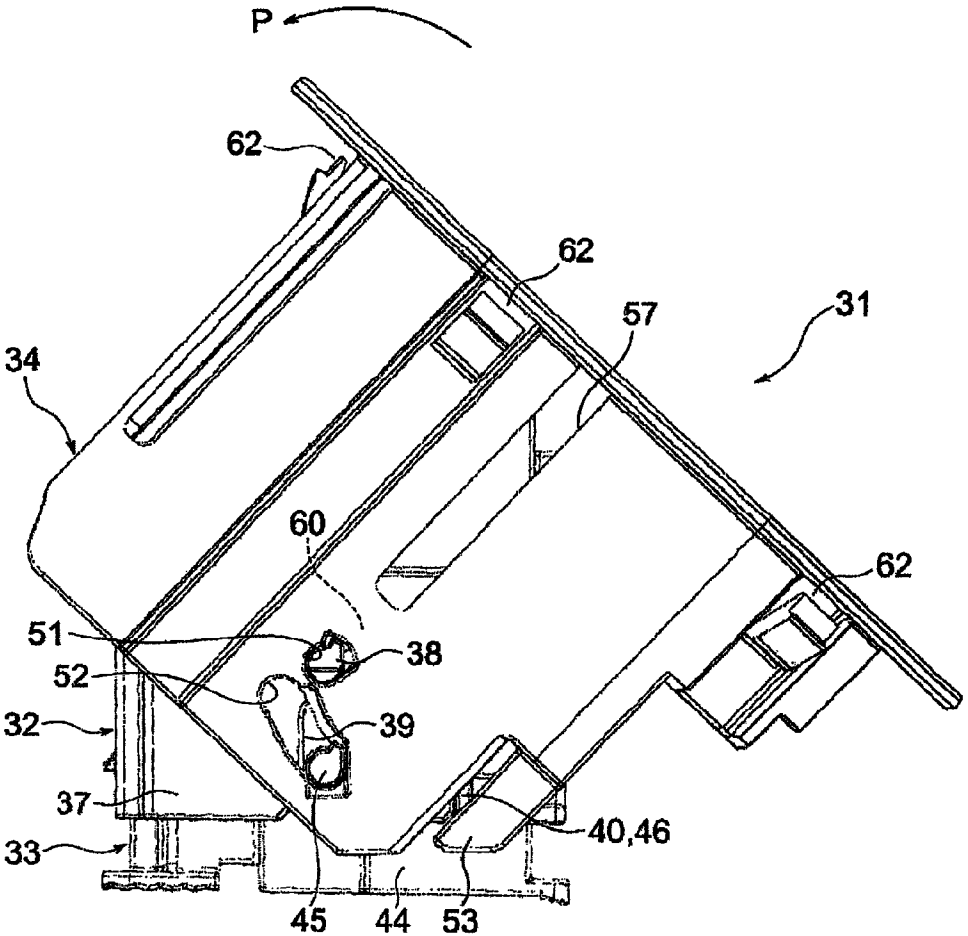
FIG. 6 is a view showing a condition in which a fitting operation of a second connector is started.
Figure 7:
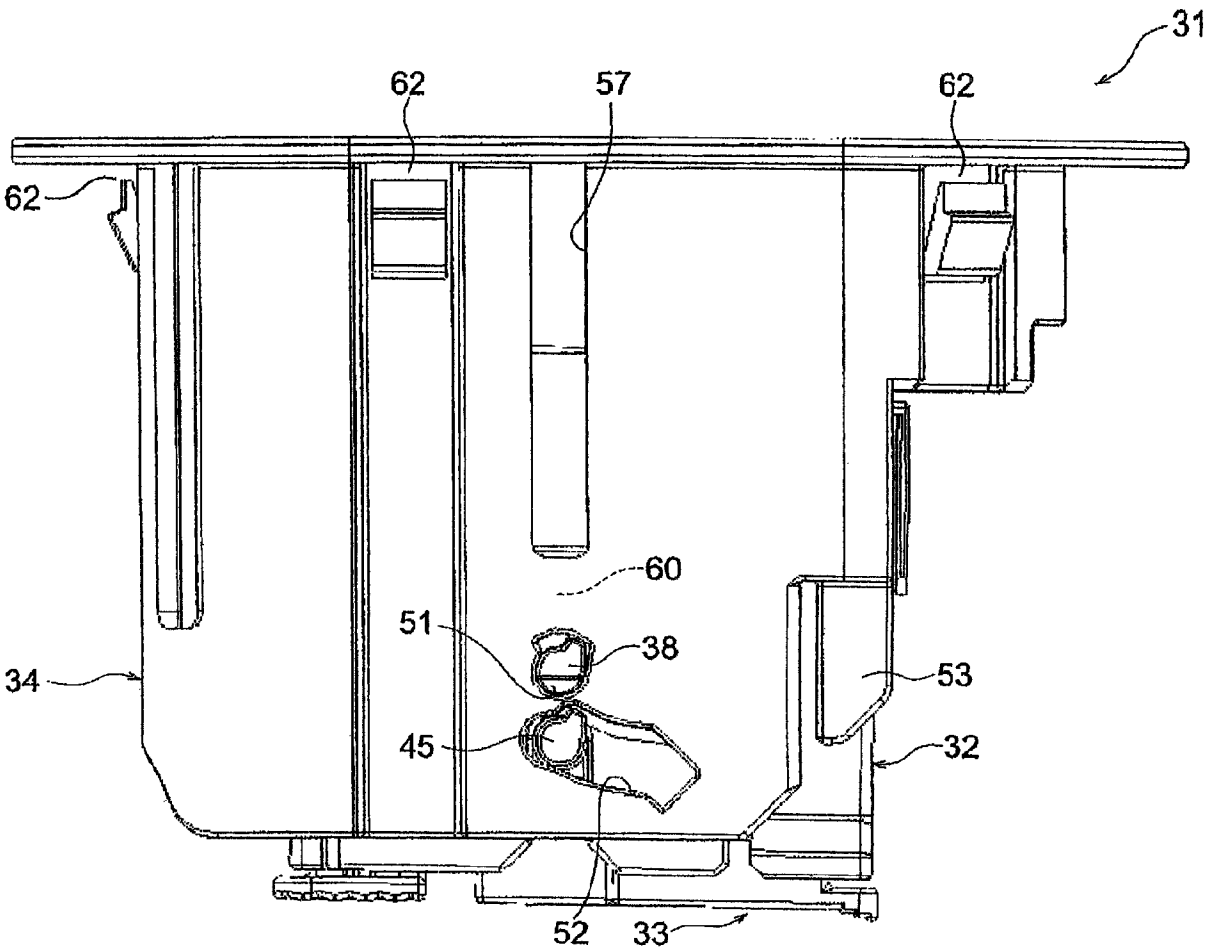
FIG. 7 is a view showing a condition in which the fitting operation of the second connector is completed.
Figure 8B:
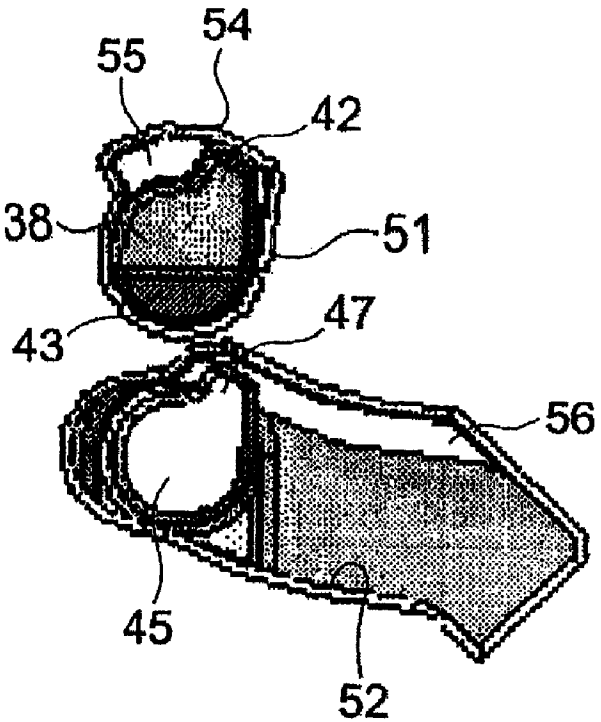
FIGS. 8A and 8B are views showing the positional relation between the first lever opening prevention projection and the first projection engagement recess portion and the positional relation between a second lever opening prevention projection and a second projection engagement recess portion.
Figure 8A:
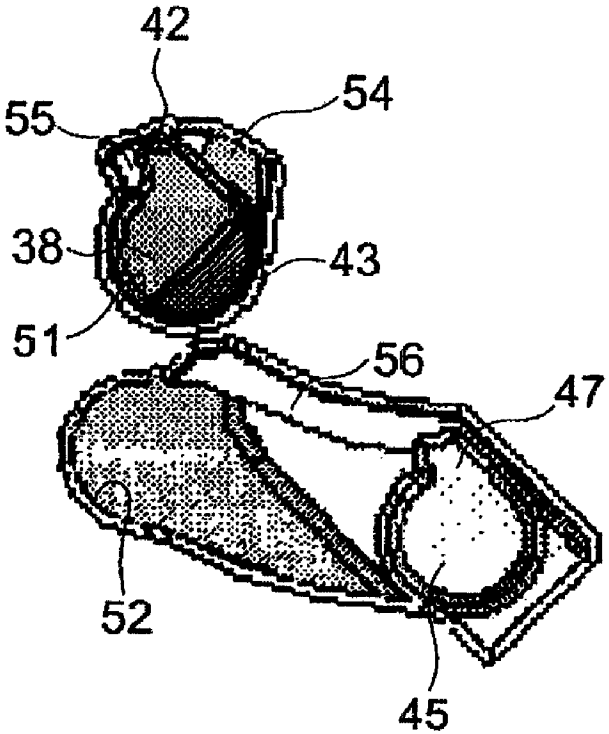
Figure 9:
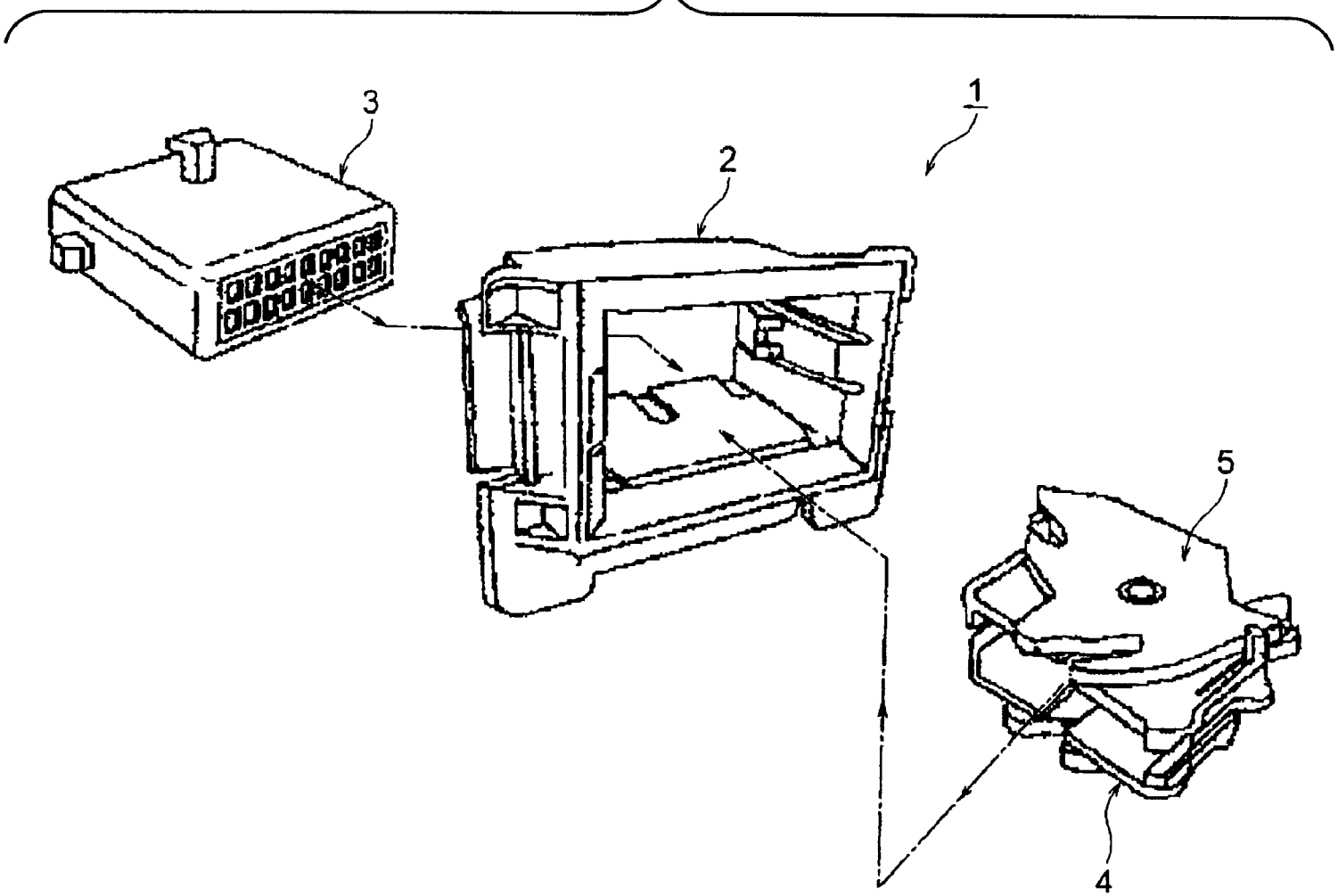
FIG. 9 is an exploded perspective view of a conventional LIF connector.
Figure 10B:
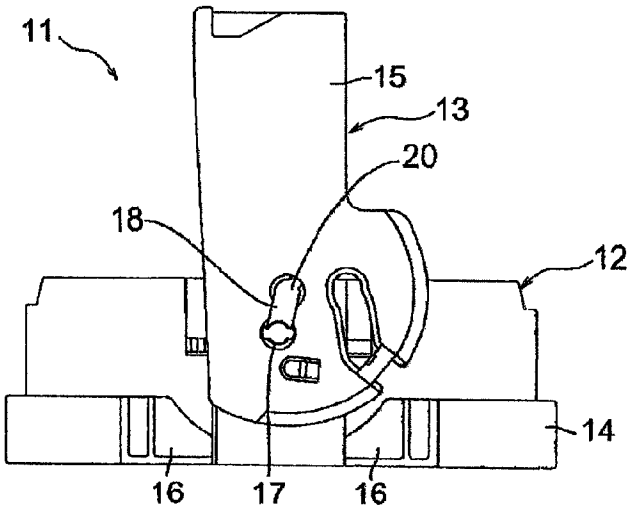
FIGS. 10A to 10C are views showing another conventional LIF connector.
Figure 10C:
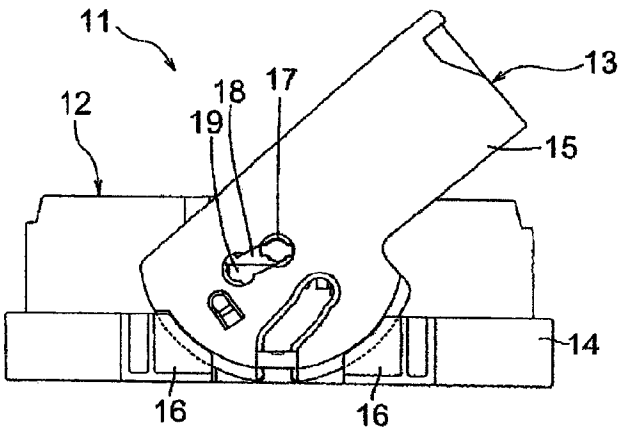
Figure 10A:
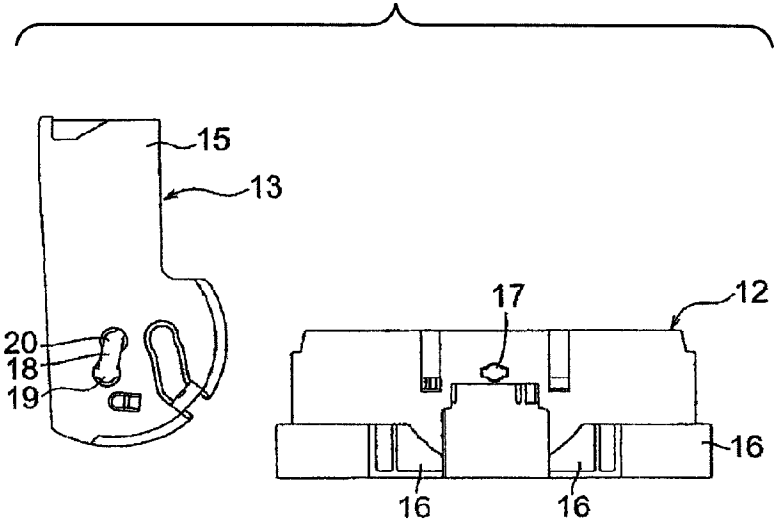

FIGS. 5A and 5B are views showing the positional relation between a first lever opening prevention projection and a first projection engagement recess portion, and FIG. 5A shows a condition in which the first connector is received, and FIG. 5B shows a condition in which the first connector is provisionally-retained. FIG. 6 is a view showing a condition in which a fitting operation of a second connector is started, and FIG. 7 is a view showing a condition in which the fitting operation of the second connector is completed. FIGS. 8A and 8B are views showing the positional relation between the first lever opening prevention projection and the first projection engagement recess portion and the positional relation between a second lever opening prevention projection and a second projection engagement recess portion, and FIG. 8A shows a condition in which the fitting operation of the second connector is started, and FIG. 8B shows the condition in which the fitting operation of the second connector is completed.

In FIG. 1, the vehicle body panel fixing-purpose LIF connector 31 includes the first connector 32, the second connector 33 and the lever-cum-vehicle body retaining member (lever-cum-retaining member) 34. Thus, the vehicle body panel fixing-purpose LIF connector 31 is formed by the three parts. The first connector 32 is adapted to be mounted in the lever-cum-vehicle body retaining member 34 in such a manner that the former is received in the latter. The first connector 32 and the second connector 33 can be fitted together by operating the lever-cum-vehicle body retaining member 34. The first connector 32 and the second connector 33 are fitted together to form the vehicle body panel fixing-purpose LIF connector 31, and then this LIF connector 31 is retained on a vehicle body panel of an automobile or the like, and is fixed thereto although this is not particularly shown in the drawings (Since the LIF connector 31 of the invention is adapted to be fixed to the vehicle body panel, this LIF connector is called "the vehicle body panel fixing-purpose LIF connector. However, the member to which the LIF connector of the invention is fixed is not limited to the vehicle body panel, and the LIF connector of the invention can be applied to a relay block, a connector block or the like for mounting on a vehicle.

First, the component parts of the LIF connector 31 will be described. In FIGS. 1 to 3, the first connector 32 includes a first connector housing 35 made of an insulative synthetic resin, and many male metal terminals (not shown) received in the first connector housing 35. Each male metal terminal is secured to an end portion of a wire. The first connector 32 is formed as a multi-pole connector having many male metal terminals. Many wires connected to the respective male metal terminals are led out from a rear portion of the first connector housing 35 although this is not particularly shown in the drawings.

The first connector housing 35 has a connector fitting portion 37 formed at a front portion thereof, and in the fitting operation, the second connector 33 is inserted into this connector fitting portion 37. The connector fitting portion 37 has an opening conforming in shape to the second connector 33. An internal space is formed between the opening and an inner wall of the connector fitting portion 37. The male metal terminals (not shown) project into this internal space. When the connector fitting operation is performed by inserting the second connector 33 into the connector fitting portion 37, the male metal terminals are contacted respectively with female metal terminals (not shown) in the second connector 33, and therefore are electrically connected to these female metal terminals, respectively.

The first connector housing 35 has a pair of fulcrum bosses 38, a pair of application point boss relief grooves 39 (corresponding to the second groove), and a pair of provisionally-retaining projection relief grooves 40. Also, reverse mounting prevention projections 41 (see FIG. 2) are formed on the first connector housing 35.

Fulcrum bosses 38 each in the form of a projection of a round cross-section are formed on generally-central portions of upper and lower surfaces (FIGS. 1 and 2) of the first connector housing 35, respectively. The first lever opening prevention projection 42 (corresponding to first projection) and a tapered portion 43 are formed at a distal end of the fulcrum boss 38 (see FIG. 5). The first lever opening prevention projection 42 projects in a direction perpendicular to an axis of the boss 38. The first lever opening prevention projection 42 is formed as a small projection.

The application point boss relief groove 39 is a groove-like notch extending straight from the opening of the connector fitting portion 37 to the vicinity of the fulcrum boss 38. The provisionally-retaining projection relief grooves 40 are so formed as to be located in a position where the first connector 32 and the lever-cum-vehicle body retaining member 34 are provisionally retained relative to each other. The provisionally-retaining projection relief groove 40 is a short narrow groove-like notch extending straight from the above-mentioned opening.

The reverse mounting prevention projection 41 is formed such that if the first connector 32 is inserted into the lever-cum-vehicle body retaining member 34 in an improper direction, this reverse mounting is detected by the reverse mounting prevention projection 41. The reverse mounting prevention projection 41 is so formed as to be opposed to a projection introduction portion or a projection abutment portion (described later) of the lever-cum-vehicle body retaining member 34.

The second connector 33 has a second connector housing 44 made of an insulative synthetic resin, and many female metal terminals (not shown) accommodated in the second connector housing 44. Each female metal terminal is secured to an end portion of a wire. The second connector 33 is formed as a multi-pole connector having many female metal terminals. Many wires connected to the respective female metal terminals are led out from a rear portion 36*b* of the second connector housing 44 although this is not particularly shown in the drawings.

A pair of application point bosses 45 and a pair of lever provisional retaining release projections 46 are formed on the second connector housing 44. The application point boss 45 is a so-called cam, and is in the form of a projection of a round cross-section. The application point bosses are formed respectively at generally-central portions of upper and lower surfaces (FIG. 1A) of the second connector housing 44. The second lever opening prevention projection 47 (corresponding to the second projection) is formed at a distal end of the application point boss 45 (see FIG. 8). The second lever opening prevention projection 47 projects in a direction perpendicular to an axis of the boss 45. The second lever opening prevention projection 47 is formed as a small projection.

The lever provisional retaining release projections 46 are so formed as to be located in the position where the first connector 32 and the lever-cum-vehicle body retaining member 34 are provisionally retained relative to each other.

In FIGS. 1 to 4, the lever-cum-vehicle body retaining member 34 functions as a lever for fitting the first connector 32 and the second connector 33 together, and also functions as a connector holder for retaining the mutually-fitted first and second connectors 32 and 33 on the above-mentioned vehicle body panel (not shown). The lever-cum-vehicle body retaining member 34 is formed, for example, into a generally tubular shape as shown in the drawings. The lever-cum-vehicle body retaining member 34 has such a structure that the first connector 32 can be accommodated in the lever-cum-vehicle body retaining member 34 by the use of an automation machine.

A front portion and a rear portion of the lever-cum-vehicle body retaining member 34, as well as part of a side wall (peripheral wall) thereof, are open. Reference numeral 48 denotes a front opening. Reference numeral 49 denotes a rear opening. Reference numeral 50 denotes an opening in the side wall.

A pair of fulcrum boss guide holes 51, a pair of application point boss guide grooves 52 (corresponding to the first groove) and a pair of lever provisionally-retaining projections 53 are formed at the opening 48 of the lever-cum-vehicle body retaining member 34 and the vicinities thereof Each fulcrum boss guide hole 51 is so shaped and disposed as to receive the fulcrum boss 38 of the first connector 32 therein.

The shape of the fulcrum boss guide hole 51 will be described more specifically. The fulcrum boss guide hole 51 is in the form of a round hole (see FIGS. 4 and 5), and a projection relief portion 54 for the first lever opening prevention projection 42 of the fulcrum boss 38 and a first projection engagement recess portion 55 for the first lever opening prevention projection 42 are formed at an edge portion of the fulcrum boss guide hole 51. The projection relief portion 54 and the first projection engagement recess portion 55 are disposed adjacent to each other to jointly assume a generally arc-shape (The angle forming this arc is acute.). The projection relief portion 54 and the first projection engagement recess portion 55 are formed at that portion of the edge portion of the fulcrum boss guide hole 51 facing away from the application point boss guide groove 52. The first lever opening prevention projection 42 is adapted to be engaged with the first projection engagement recess portion 55 (When the two first lever opening prevention projections 42 are engaged respectively with the first projection engagement recess portions 55, the opening (that is, the opening deformation) of the lever-cum-vehicle body retaining member 34 is prevented.).

The lever-cum-vehicle body retaining member 34 is mounted on the first connector 32 in such a manner that the fulcrum bosses 38 are fitted in the respective fulcrum boss guide holes 51, and by doing so, the lever-cum-vehicle body retaining member 34 can be pivotally moved in a predetermined direction relative to the first connector 32. This mounting operation (in which the fulcrum bosses 38 are fitted into the respective fulcrum boss guide holes 51), etc., will be described later.

The application point boss guide groove 52 is in the form of a groove-like notch extending obliquely from the opening 48 to the vicinity of the fulcrum boss guide hole 51. The application point boss guide groove 52 is formed as a so-called cam groove. When the lever-cum-vehicle body retaining member 34 is disposed in the provisionally-retained condition relative to the first connector 32, the application point boss guide groove 52 overlaps the application point boss relief groove 39 of the first connector 32.

A second projection engagement recess portion 56 (with which the second lever opening prevention projection 47 of the application point boss 45 can be engaged) is formed at an edge portion of the application point boss guide groove 52 (When the two second lever opening prevention projections 47 are engaged respectively with the second projection engagement recess portions 56, the opening deformation of the lever-cum-vehicle body retaining member 34 is prevented.). The second projection engagement recess portion 56 is formed at that portion of the edge portion of the guide groove 52 disposed close to the fulcrum boss guide hole 51.

The lever provisionally-retaining projections 53 serve to hold the lever-cum-vehicle body retaining member 34 and the first connector 32 in the provisionally-retained condition, and can be engaged with the opening of the first connector housing 35 of the first connector 32 (that is, can be engaged in the provisionally-retaining projection relief groove 40).

When the provisionally-retained condition is established by the lever provisionally-retaining projections 53 (see FIG. 1), the center axis of the lever-cum-vehicle body retaining member 34 is not disposed parallel to the center axis of the first connector 32, but intersects the center axis of the first connector 32 at a predetermined angle (The two center lines are disposed parallel to each other in two conditions, that is, when the first connector 32 is inserted into the lever-cum-vehicle body retaining member 34 and when the first connector 32 and the second connector 33 are completely fitted together.).

The opening 49 of the lever-cum-vehicle body retaining member 34 serves as a first connector introduction portion when inserting and accommodating the first connector 32 into the lever-cum-vehicle body retaining member 34. The opening 49 also serves as a lead-out portion through which the wires extending from the first connector 32 are led out. A pair of fulcrum boss guide grooves 57 are formed in the opening 49, and extend straight from the outer end of the opening 49 respectively toward the fulcrum boss guide holes 51. Further, projection introduction portions 58 for the reverse mounting prevention projections 41 of the first connector 32, as well as projection abutment portions 59 for the reverse mounting prevention projections 41, are formed at the opening 49.

The lever-cum-vehicle body retaining member 34 has fulcrum boss passage portions 60 each formed between the fulcrum boss guide groove 57 and the fulcrum boss guide hole 51. When the first connector 32 is inserted into the lever-cum-vehicle body retaining member 34, the fulcrum bosses 38 pass over the fulcrum boss passage portions 60, respectively.

The fulcrum boss introduction guide grooves 57 serve to prevent the opening deformation of the lever-cum-vehicle body retaining member 34 when the first connector 32 is inserted into the lever-cum-vehicle body retaining member 34. On the other hand, the fulcrum boss passage portions 60 cause the lever-cum-vehicle body retaining member 34 to be instantaneously deformed to be opened when the fulcrum bosses 38 slide over the respective fulcrum boss passage portions 60. A tapered portion 61 (see FIG. 3) (with which the tapered portion 43 of the fulcrum boss 38 can be brought into abutting engagement) is formed at the fulcrum boss passage portion 60.

Because of the provision of the tapered portion 43 and the tapered portion 61 of the fulcrum boss passage portion 60, each fulcrum boss 38 smoothly slides over the fulcrum boss passage portion 60, and is fitted into the fulcrum boss guide hole 51.

Each projection introduction portion 58 is formed into such a groove-shape as to receive the reverse mounting prevention projection 41 of the first connector 32 therein and to guide this projection 41 therealong. On the other hand, the projection abutment portion 59 is formed such that when the first connector 32 is to be reversely mounted, the reverse mounting prevention projection 41 abuts against the projection abutment portion 59, thereby preventing the first connector 32 from being received in the lever-cum-vehicle body retaining member 34.

A panel retaining structural portion 62 (serving as a retaining structure for being retained on the vehicle body panel (not shown)) is formed at the opening 49 of the lever-cum-vehicle body retaining member 34. The panel retaining structural portion 62 includes a panel abutment flange 63, and a plurality of panel retaining arms 64. The panel abutment flange 63 and the panel retaining arms 64 are so disposed that the vehicle body panel can be held between the panel abutment flange 63 and each panel retaining arm 64.

The panel abutment flange 63 is so formed as to be disposed in face-to-face contact with the vehicle body panel. The panel retaining arm 64 is formed into a cantilever-like shape, and has an engagement portion for retaining engagement with the vehicle body panel. By elastically deforming each panel retaining arm 64, its retaining engagement can be canceled.

Here, a supplementary explanation will be given with respect to the first and second connectors 32 and 33 and the lever-cum-vehicle body retaining member 34. The fulcrum bosses 38, the application point boss relief grooves 39, the application point bosses 45, the fulcrum boss guide holes 51 and the application point boss guide grooves 52 jointly form a LIF mechanism for enabling the first and second connectors 32 and 33 to be fitted together with a low insertion force.

The vehicle body panel (not shown) is provided, for example, at a door portion of the automobile or at a region between an engine room and a passenger compartment, and this vehicle body panel has a predetermined thickness, and has a flat surface. A panel through hole is formed through this vehicle body panel. The vehicle body panel fixing-purpose LIF connector 31 is adapted to be retained and fixed to a peripheral edge portion of the panel through hole.

Next, the operation for assembling the vehicle body panel fixing-purpose LIF connector 31 and the operation for fixing (retaining) the LIF connector 31 to the vehicle body panel (not shown) will be described.

After the first connector 32 and the second connector 33 are formed by a known production method, first, the first connector 32 is located in opposed relation to the opening 49 of the lever-cum-vehicle body retaining member 34 as shown in FIG. 2. Then, the first connector 32 is inserted straight into the lever-cum-vehicle body retaining member 34, and is received therein (In this embodiment, this receiving operation is effected by an automation machine.). At the time of reception of the first connector 32, each fulcrum boss 38 is guided to the fulcrum boss passage portion 60 by the fulcrum boss introduction guide groove 57 (see FIGS. 3 and 4), and then the fulcrum boss 38 slides over the fulcrum boss passage portion 60, and is fitted into the fulcrum boss guide hole 51, so that the lever-cum-vehicle body retaining member 34 can be pivotally moved relative to the first connector 32.

Immediately after the first connector 32 is received in the lever-cum-vehicle body retaining member 34, the first lever opening prevention projection 42 of the fulcrum boss 38 is disposed in the projection relief portion 54 formed at the edge portion of the fulcrum boss guide hole 51, as shown in FIG. 5A, and in this condition, the lever-cum-vehicle body retaining member 34 is pivotally moved into the provisionally-retained condition relative to the first connector 32 (see FIG. 1A), and during this operation, the first lever opening prevention projection 42 is engaged with the first projection engagement recess portion 55. Because of the engagement of each first lever opening prevention projection 42 with the first projection engagement recess portion 55, the opening deformation of the lever-cum-vehicle body retaining member 34 is prevented.

The above provisionally-retained condition is achieved by rotatably fitting each fulcrum boss 38 of the first connector 32 in the fulcrum boss guide hole 51 of the lever-cum-vehicle body retaining member 34 and then by retainingly engaging each lever provisionally-retaining projection 53 of the lever-cum-vehicle body retaining member 34 with the opening of the first connector 32 (see FIG. 1). By thus retainingly engaging each lever provisionally-retaining projection 53 with the opening of the connector fitting portion 37 of the first connector 32, the lever-cum-vehicle body retaining member 34 and the first connector 32 are held in the provisionally-retained condition relative to each other.

Then, the second connector 33 is moved to be opposed to the lever-cum-vehicle body retaining member 34 and the first connector held in the provisionally-retained condition relative to each other (See FIG. 1A. At this time, the second connector 33 has already been passed through the panel through hole formed through the vehicle body panel.). Then, the second connector 33 is inserted into the connector fitting portion 37, and then the fitting of the first and second connectors 32 and 33 to each other is started (see FIG. 6).

When the second connector 33 is thus inserted into the connector fitting portion 37, the lever provisional retaining release projections 46 of the second connector 33 are brought into abutting engagement with the respective lever provisionally-retaining projections 53 of the lever-cum-vehicle body retaining member 34, and subsequently each lever provisionally-retaining projection 53 is pushed up by the lever provisional retaining release projection 46. As a result, the above provisionally-retained condition is canceled.

The fitting of the first and second connectors 32 and 33 to each other is started by pivotally moving the lever-cum-vehicle body retaining member 34 in a direction P (see FIG. 6). Then, in accordance with the pivotal movement of the lever-cum-vehicle body retaining member 34, the LIF mechanism (including the application point bosses 45, the application point guide grooves 52, and so on.) performs its function, and therefore the second connector 33 is drawn toward the first connector 32, so that the connector fitted condition is achieved as shown in FIG. 7. Thus, the assembling operation of the vehicle body panel fixing-purpose LIF connector 31 is finished.

Here, the prevention of the opening deformation of the lever-cum-vehicle body retaining member 34 will be further described. At the time of starting the fitting of the first and second connectors 32 and 33 to each other, the first lever opening prevention projection 42 is engaged with the first projection engagement recess portion 55, and also the second lever opening prevention projection 47 is engaged with the second projection engagement recess portion 56 as shown in FIG. 8A. Therefore, the opening deformation of the lever-cum-vehicle body retaining member 34 is prevented by the engagement at two regions, that is, the engagement of the two lever opening prevention projections 42 and 47 with the lever-cum-vehicle body retaining member 34 (In this embodiment, one large opening prevention projection is not formed, but the small opening prevention projections are formed so as to be disposed at the two regions, thereby the sizes of the relevant portions are reduced. In connection with the small-size design, the distance between the fulcrum boss guide groove 51 and the application point guide groove 52 is reduced, and by doing so, the leverage is increased so as to reduce the lever operating force.).

During the time when the lever-cum-vehicle body retaining member 34 is pivotally moved to draw the second connector 33 toward the first connector 32, the engagement of the two lever opening prevention projections 42 and 47 with the lever-cum-vehicle body retaining member 34 is maintained, thereby preventing the opening deformation of the lever-cum-vehicle body retaining member 34. When the connector fitted condition is achieved, the first lever opening prevention projection 42 is moved into the projection relief portion 54, so that only the engagement of the second lever opening prevention projection 47 with the second projection engagement recess 56 is maintained. However, at this time, the lever-cum-vehicle body retaining member 34 is not in the process of being pivotally moved, and therefore the opening deformation of the lever-cum-vehicle body retaining member 34 can be sufficiently prevented only by the engagement at one region.

After the assembling operation of the vehicle body panel fixing-purpose LIF connector 31 is finished, this LIF connector 31 is inserted into the panel through hole of the vehicle body panel, with its front portion 48 first introduced thereinto, and is fixed to the vehicle body panel. In this fixing operation, the panel retaining structural portion 62 of the lever-cum-vehicle body retaining member 34 is used. After the fixing of the LIF connector 31 to the vehicle body panel is completed, a series of operations mentioned above are finished. It will be appreciated that the series of operations can be carried out very efficiently since the number of the component parts is small.

As described above with reference to FIGS. 1 to 8, in the present invention, the vehicle body panel fixing-purpose LIF connector 31 can be formed by a smaller number of component parts as compared with the conventional LIF connectors. And besides, because of the smaller number of the component parts, the efficiency of the assembling operation can be enhanced.

Furthermore, in the invention, the lever-cum-vehicle body retaining member 34 has the fulcrum boss guide grooves 57 and the fulcrum boss passage portions 60 for the fulcrum bosses 38 so that the first connector 32 can be inserted straight into the lever-cum-vehicle body retaining member 34 to be mounted therein. Therefore, the LIF connector 31 has the structure meeting the automatic assembling operation. In the present invention, slide holes as in the conventional connectors are not formed, and therefore the support portions for supporting the fulcrum bosses 38 can be sufficiently secured, and the vehicle body panel fixing-purpose LIF connector having a good operability can be provided.

In the present invention, various modifications can be made without departing from the subject matter of the invention.

What is claimed is:

1. A low insertion force connector comprising:

a frame forming an opening and including a guide hole, a fulcrum boss guide groove extending from the opening to the guide hole, a fulcrum boss passage portion formed between the guide hole and the fulcrum boss guide groove, and a first groove;

a first connector accommodated by the frame through the opening and including a fulcrum boss to be engaged with the guide hole by passing through the fulcrum boss guide groove and the fulcrum boss passage portion, and a second groove; and a second connector including an application boss engaged with the first and the second groove, wherein the second connector is drawn to the first connector by pivotally moving the frame.

2. The LIF connector according to claim 1, wherein at least one of the fulcrum boss and the fulcrum boss passage portion including a tapered portion for overriding during engagement between the first connector and the frame.

3. The LIF connector according to claim 1, wherein the first connector further includes a projection and the frame includes an abutment portion on which the projection abuts and a projection introduction potion into which the projection is received so as to prevent inverse engagement between the first connector and the frame.

4. The LIF connector according to claim 1, wherein the fulcrum boss has a first lever opening prevention projection projecting perpendicular to the axis of the fulcrum boss; and a first projection relief portion and a first projection engagement portion for the first lever opening prevention projection are formed on a periphery of the guide hole.

5. The LIF connector according to claim 4, wherein the application boss includes a second lever opening prevention projection projecting perpendicular to the axis of the application boss; and a second projection relief portion and a second projection engagement portion for the second lever opening prevention projection are formed on a periphery of the first groove, wherein at least one of the first lever opening prevention projection and the second lever opening prevention projection is engaged with the first projection engagement portion and the second projection engagement portion respectively at least during pivotal movement of the frame.

6. The LIF connector according to claim 1, wherein the fulcrum boss guide groove linearly extends from the opening.

* * * * *